US007556260B2

(12) United States Patent
Yoshimoto et al.

(10) Patent No.: US 7,556,260 B2
(45) Date of Patent: Jul. 7, 2009

(54) IMAGE FORMING APPARATUS

(75) Inventors: Satoshi Yoshimoto, Tokyo (JP); Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 127 days.

(21) Appl. No.: 11/902,972

(22) Filed: Sep. 27, 2007

(65) Prior Publication Data

US 2008/0080917 A1 Apr. 3, 2008

(30) Foreign Application Priority Data

Sep. 29, 2006 (JP) ..... 2006-268784

(51) Int. Cl.
*B65H 29/70* (2006.01)
*B65H 31/00* (2006.01)

(52) U.S. Cl. ..... 271/188; 271/209; 271/264

(58) Field of Classification Search ..... 271/188, 271/209, 294
See application file for complete search history.

(56) References Cited

U.S. PATENT DOCUMENTS 5,237,381 A * 8/1993 Hamada ..... 399/406
6,503,011 B2 * 1/2003 Kono ..... 400/646
7,040,615 B2 * 5/2006 Suzuki et al. ..... 271/188
7,246,962 B2 * 7/2007 James et al. ..... 400/636

FOREIGN PATENT DOCUMENTS

JP 11-095587 4/1999

* cited by examiner

*Primary Examiner*—Patrick H Mackey
*Assistant Examiner*—Luis Gonzalez
(74) *Attorney, Agent, or Firm*—Kubotera & Associates, LLC

(57) ABSTRACT

An image forming apparatus includes a driving roller for transporting a medium; a follower roller disposed to face the driving roller for transporting the medium; a guide member for guiding the medium to change a transport direction thereof by an angle greater than 30°; and a rotational member disposed to be freely rotatable at a position corresponding to a side edge of the medium. Accordingly, after the driving roller and the follower roller transport the medium, when the medium contacts with the guide member, side edges of the medium contact with the guide member at an angle smaller than that of a center portion of the medium contacting with the guide member.

6 Claims, 14 Drawing Sheets

IMAGE FORMING APPARATUS

BACKGROUND OF THE INVENTION AND RELATED ART STATEMENT

The present invention relates to an image forming apparatus.

In a conventional image forming apparatus such as a printer, a copier, a fax machine, and a multifunction machine thereof, a charging roller charges a surface of a photoreceptor drum constantly and evenly, and an exposure device exposes the surface of the photoreceptor drum to form an electrostatic latent image thereon. A developing device develops the electrostatic latent image to form a toner image, and a transfer roller transfers the toner image to a sheet as a medium. Then, a fixing device fixes the toner image on the sheet, thereby forming an image on the sheet in a printing operation.

In the conventional image forming apparatus, a driving roller and a follower roller abutting against with each other are disposed at a downstream side of the fixing device in a direction that the sheet is transported for discharging the sheet. A guide member having a semicircle shape is disposed at a downstream side of the driving roller and the follower roller. After the sheet is discharged from the fixing device, the sheet is transported with a printed surface thereof facing upward and passes through the driving roller and the follower roller. Then, the sheet is guided by the guide member while the printed surface faces downward, and then discharged from a printer main body to a stocker (refer to Patent Reference).

Patent Reference: Japanese Patent Publication No. 11-95587

In the conventional printer, when the sheet is discharged from between the driving roller and the follower roller, side edges of the sheet bend downward because of gravity, and a front end of the sheet becomes a mountain shape. In this situation, side edges of the front end of the sheet contact with the guide member first. Accordingly, the both edges touch the guide member at an angle larger than that of a center portion of the sheet. As a result, the side edges of the front end of the sheet may cause a paper jam or a paper fold, thereby making it difficult to transport the sheet smoothly.

In the view of the problem described above, an object of the present invention is to provide an image forming apparatus capable of solving the problem and transporting a medium smoothly.

Further objects and advantages of the invention will be apparent from the following description of the invention.

SUMMARY OF THE INVENTION

In order to attain the objects described above, according to the present invention, an image forming apparatus includes a driving roller for transporting a medium; a follower roller disposed to face the driving roller for transporting the medium; a guide member for guiding the medium to change a transport direction thereof by an angle greater than 30°; and a rotational member disposed to be freely rotatable at a position corresponding to a side edge of the medium. Accordingly, after the driving roller and the follower roller transport the medium, when the medium contacts with the guide member, side edges of the medium contact with the guide member at an angle smaller than that of a center portion of the medium contacting with the guide member.

In the present invention, the image forming apparatus includes the driving roller for transporting the medium; the follower roller disposed to face the driving roller for transporting the medium; the guide member for guiding the medium to change the transport direction thereof by the angle greater than 30°; and the rotational member disposed to be freely rotatable at the position corresponding to the side edge of the medium. Accordingly, after the driving roller and the follower roller transport the medium, when the medium contacts with the guide member, the side edges of the medium contact with the guide member at an angle smaller than that of the center portion of the medium contacting with the guide member.

As described above, after the driving roller and the follower roller transport the medium, when the medium contacts with the guide member, the side edges of the medium contact with the guide member at an angle smaller than that of the center portion of the medium contacting with the guide member. Accordingly, it is possible to reduce a resistance force generated at the side edges of the medium upon contacting with the guide member. As a result, it is possible to prevent the side edges of the medium from being wound around the guide member and bent, thereby making it possible to smoothly transport the medium.

DESCRIPTION OF THE PREFERRED EMBODIMENTS

Hereunder, embodiments of the present invention will be explained with reference to the accompanying drawings. In the description below, a color printer is described as an example of an image forming apparatus.

First Embodiment

Figure 2:
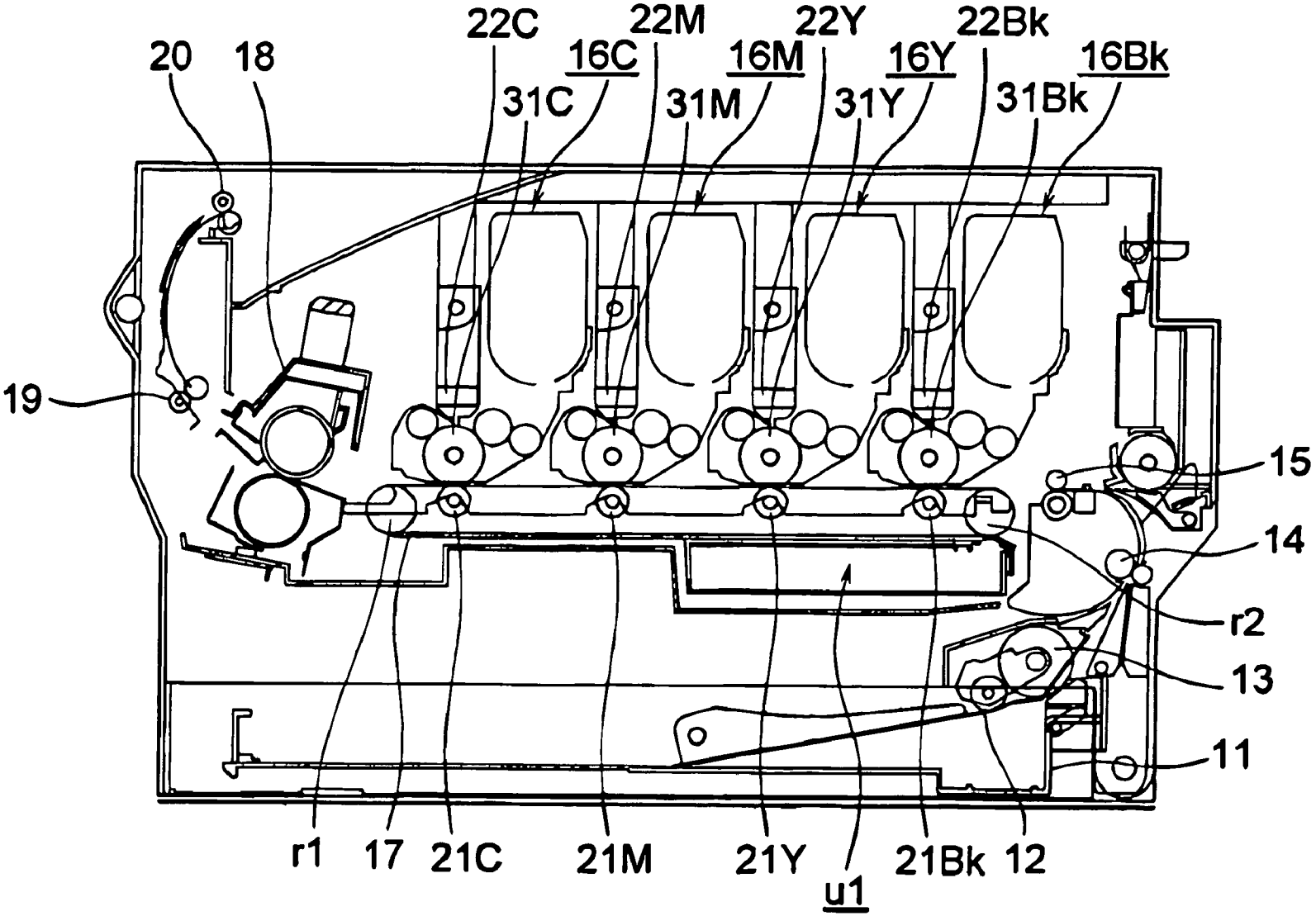
FIG. 2 is a schematic view showing a printer according to the first embodiment of the present invention.

A first embodiment of the present invention will be explained. FIG. 2 is a schematic view showing a printer according to the first embodiment of the present invention. As shown in FIG. 2, a sheet supply cassette 11 as a medium storing unit is attached to a lower portion of the printer for storing a sheet (not shown) as a medium. A sheet supply mechanism is disposed adjacent to a front edge of the sheet cassette 11 for separating and supplying the sheet one by one. The sheet supply mechanism has a sheet supply roller 12 and a separating roller 13.

After the sheet supply mechanism supplies and sends the sheet to a transporting roller 14 disposed above the sheet supply mechanism, the transporting roller 14 sends the sheet to a transporting roller 15. Afterward, the transporting roller 15 sends the sheet to image forming units 16Bk, 16Y, 16M and 16C as image forming devices for forming images in black, yellow, magenta, and cyan, respectively.

In the embodiment, photosensitive drums 31Bk, 31Y, 31M, and 31C as image supporting members are attached to the image forming units 16Bk, 16Y, 16M and 16C, respectively. LED heads 22Bk, 22Y, 22M, and 22C as exposure devices are disposed adjacent to the image forming units 16Bk, 16Y, 16M, and 16C at positions facing the photosensitive drums 31Bk, 31Y, 31M, and 31C for exposing surfaces of the photosensitive drums 31Bk, 31Y, 31M, and 31C to form static electricity latent images thereon.

In the embodiment, a transfer unit u1 is disposed along the image forming units 16Bk, 16Y, 16M, and 16C. The transfer unit u1 is formed of a driving roller r1; a follower roller r2; a transport belt 17 as a transport member freely movable and stretched between the driving roller r1 and the follower roller r2; and transfer rollers 21Bk, 21Y, 21M, and 21C as transfer members disposed facing the photosensitive drums 31Bk, 31Y, 31M, and 31C on an opposite side of the transfer belt 17.

When the transport belt 17 transports the sheet, the sheet passes through between the image forming units 16Bk, 16Y, 16M, and 16C, and the transfer rollers 21Bk, 21Y, 21M, and 21C, so that the transfer rollers 21Bk, 21Y, 21M, and 21C sequentially transfer the toner images in colors formed by the image forming units 16Bk, 16Y, 16M, and 16C onto the sheet, thereby forming color toner images.

Then, the sheet is sent to a fixing device 18 as a fixing unit, so that the color toner images are fixed onto the sheet, thereby forming a color image. After the sheet is discharged from the fixing device 18, a transport roller 19 disposed in a sheet discharge unit transports the sheet, and a discharge transport roller 20 discharges the sheet from the printer.

Figure 3:
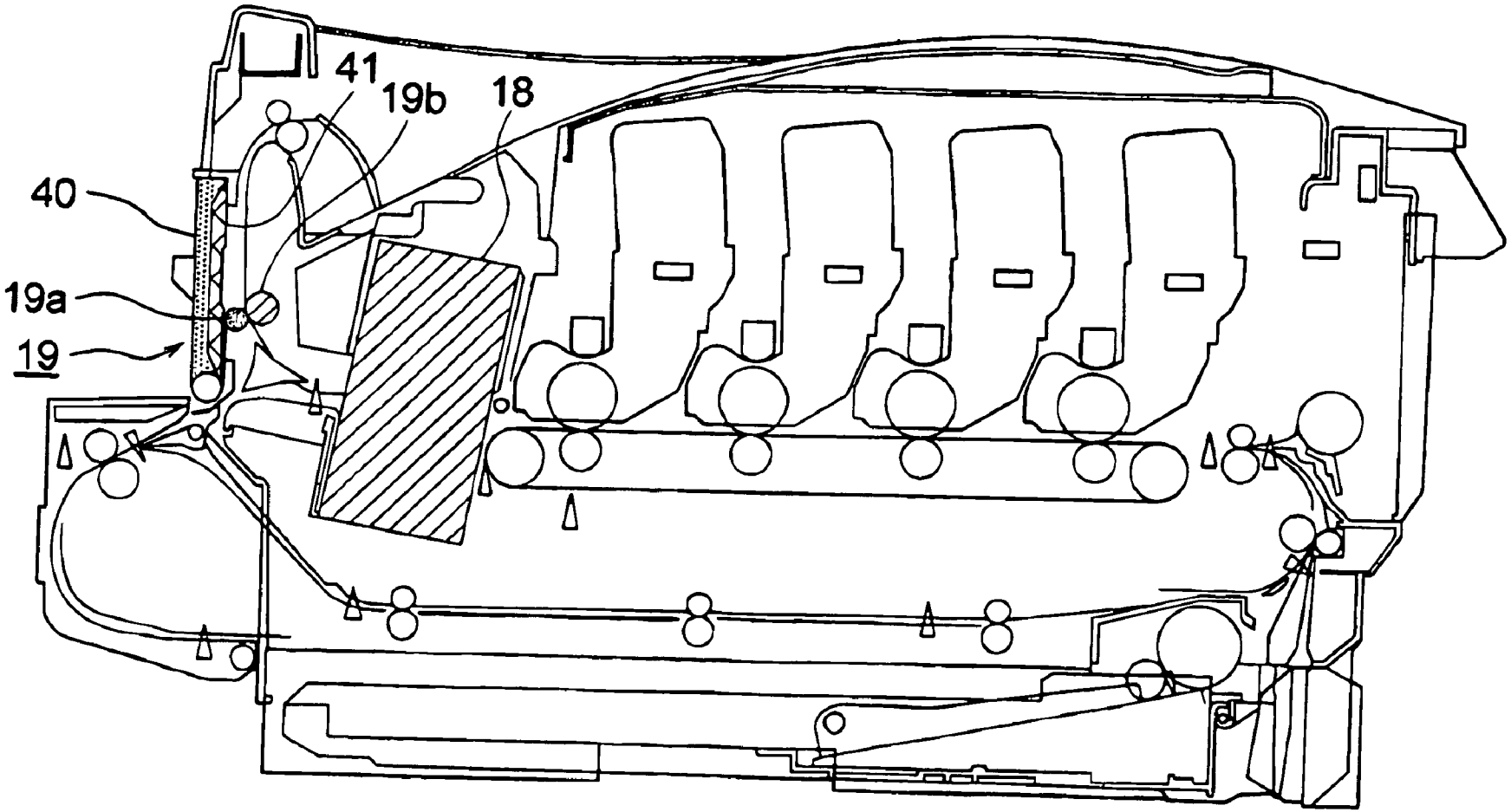
FIG. 3 is a schematic view showing the sheet discharge unit according to the first embodiment of the present invention.

FIG. 3 is schematic view showing the sheet discharge unit according to the first embodiment of the present invention. As shown in FIG. 3, the transport roller 19 is formed of a drive roller 19*a* as a first rotating body, and follower rollers 19*b* as second rotating bodies abutting against the drive roller 19*a*. The transport roller 19 is disposed on a downstream side of the fixing device 18. A guide member 41 as a first guide member is disposed adjacent to the drive roller 19*a*, and is attached to a face up cover 40 disposed to be freely rotatable for discharging the sheet. The guide member 41 and the face up cover 40 are made of a resin.

Figure 1:
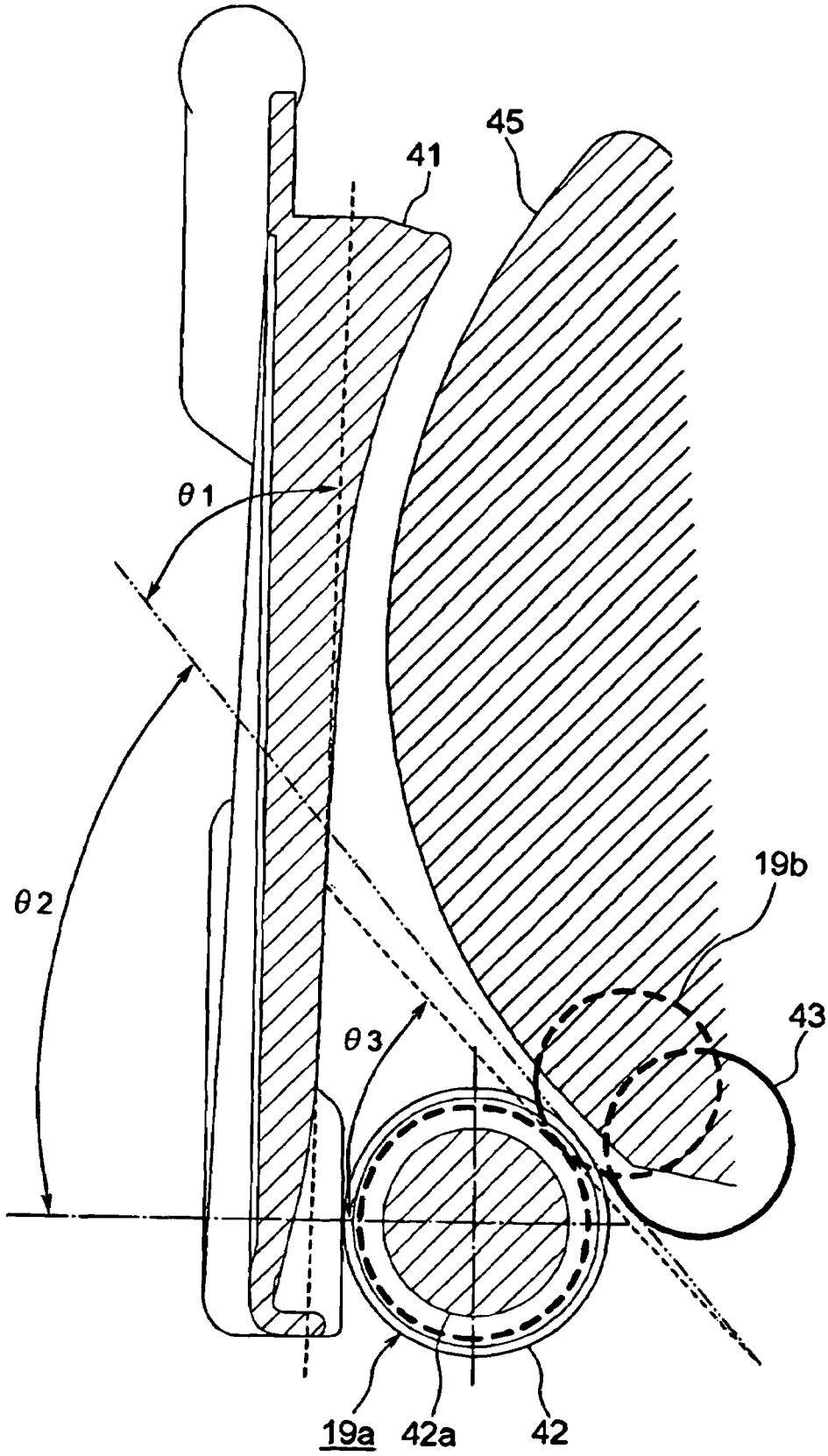
FIG. 1 is a schematic sectional view showing a sheet discharge unit according to a first embodiment of the present invention.
Figure 4:
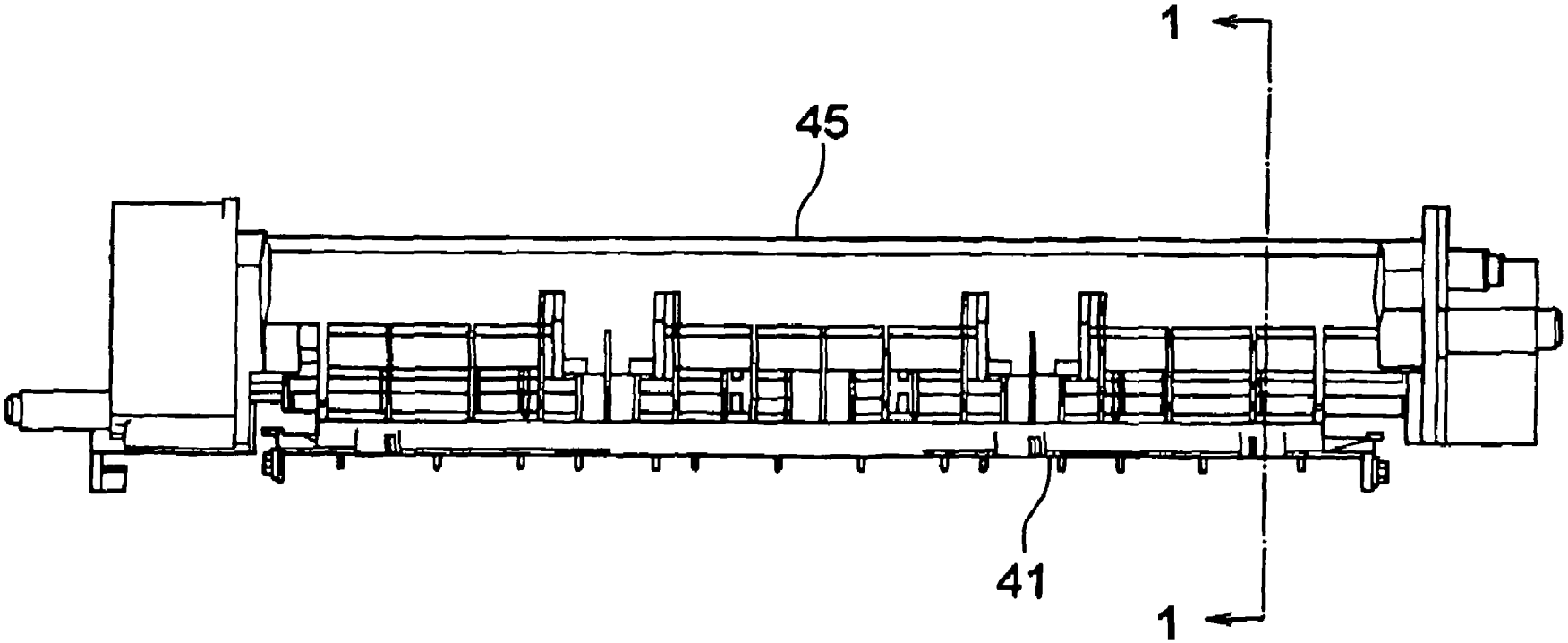
FIG. 4 is a plan view showing the sheet discharge unit according to the first embodiment of the present invention.
Figure 5:
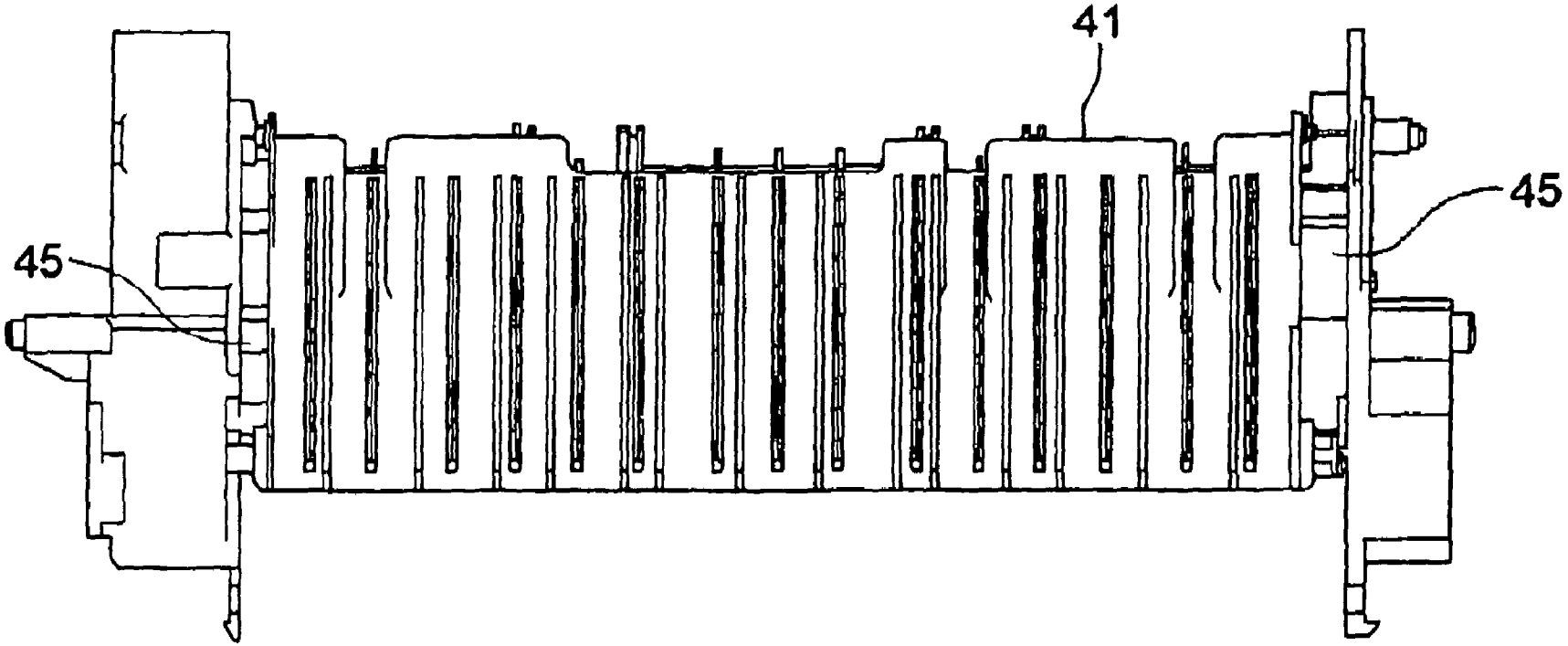
FIG. 5 is a rear view showing the sheet discharge unit according to the first embodiment of the present invention.
Figure 6:
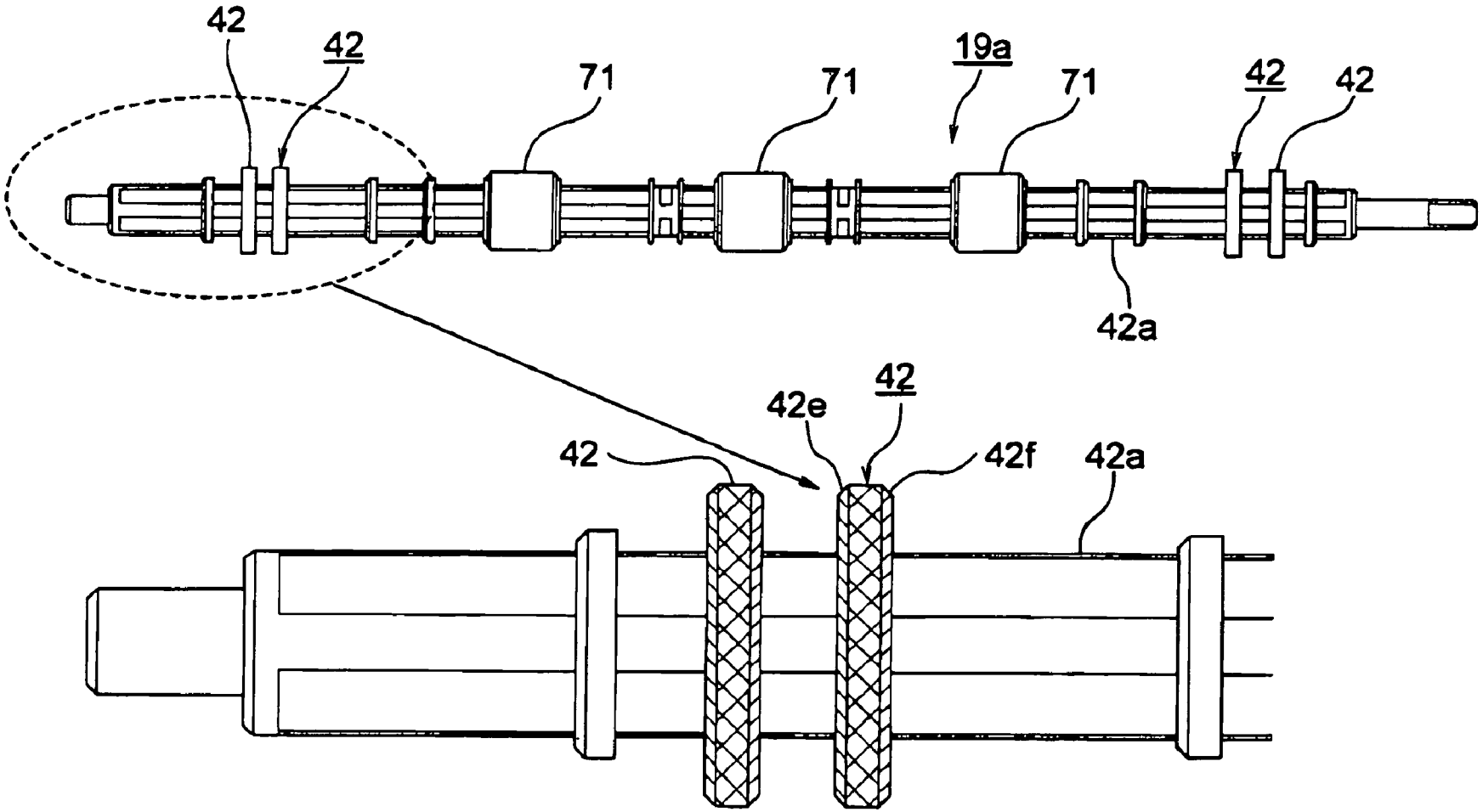
FIG. 6 is a schematic view of a shaft roller according to the first embodiment of the present invention.
Figure 7:
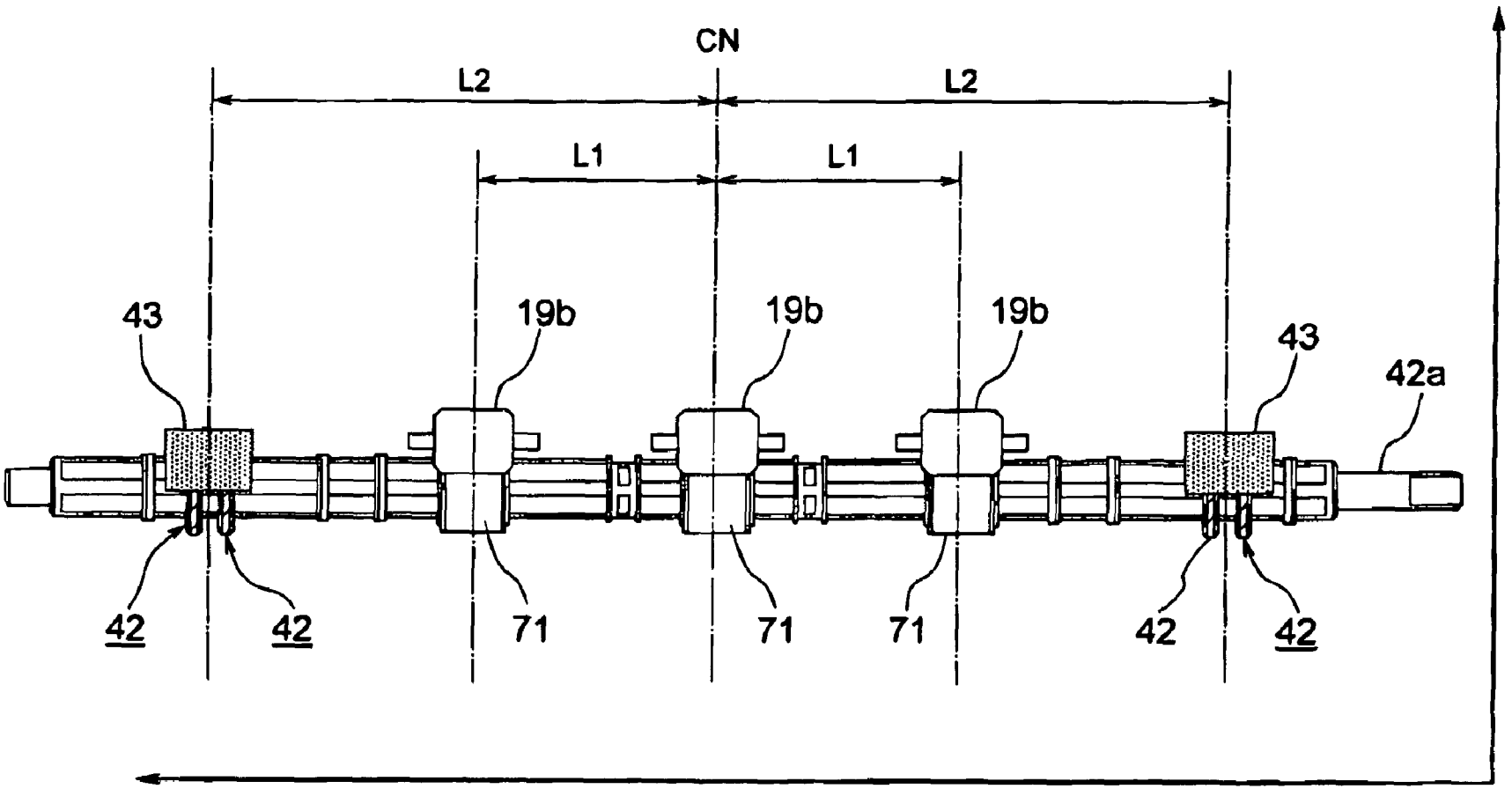
FIG. 7 is a front view showing the shaft roller, a follower roller, and a guide roller according to the first embodiment of the present invention.

FIG. 1 is a schematic sectional view showing the sheet discharge unit according to the first embodiment of the present invention. FIG. 4 is a plan view showing the sheet discharge unit according to the first embodiment of the present invention. FIG. 5 is a rear view showing the sheet discharge unit according to the first embodiment of the present invention. FIG. 6 is a schematic view showing a shaft roller according to the first embodiment of the present invention. FIG. 7 is a front view showing the shaft roller, a follower roller, and a guide roller according to the first embodiment of the present invention. FIG. 1 is a schematic sectional view taken along a line 1-1 in FIG. 4.

As shown in FIG. 1, a guide member 45 as a second guide member is disposed in a position facing the guide member 41. The drive roller 19*a*, the follower rollers 19*b*, and a guide roller 43 are disposed on a downstream side of the guide member 41 and the guide member 45.

As shown in FIG. 6, the drive roller 19*a* is formed of a shaft 42*a*, rollers 71, and shaft rollers 42. The shaft 42*a* is made out of a resin. The rollers 71 are made out of an elastic material such as a rubber, and are disposed at a plurality of locations (three locations in the embodiment) at a center part of the shaft 42*a*. The shaft rollers 42 as rotational members are deposed as a pair near each end of the shaft 42*a*, i.e., side edges of the sheet. The shaft 42*a*, the rollers 71, and the shaft rollers 42 are situated on one same axis. The rollers 71 and the shaft rollers 42 rotate conjunctively as the shaft 42*a* rotates.

In the embodiment, the follower rollers 19*b* made out of a resin are disposed at an upstream side of the drive roller 19*a*. A spring (not shown) as an urging member is attached to the guide member 45 for pressing the follower rollers 19*b* against the drive roller 19*a* with a pressing force of 50 (gf).

FIG. 7 is a front view showing the shaft roller 42, the follower rollers 19*b*, and guide rollers 43 according to the first embodiment of the present invention. As shown in FIG. 7, the rollers 71 have a diameter larger than that of the shaft 42*a*. One of the rollers 71 is positioned on a line CN crossing the center of the sheet, and the other of the rollers 71 are disposed symmetrically apart form the line CN by a distance L1.

In the embodiment, the shaft rollers 42 have a thickness of 3 (mm) and a diameter of 17 (mm) larger than that of the rollers 71. Further, the shaft rollers 42 include tapered portions 42*e* and 42*f* with a size of 0.5 (mm) at both sides of an outer circumferential edge thereof for preventing the sheet from being damaged (refer to FIG. 6). The rollers 71 have a width of 12 (mm), and the follower rollers 19*b* have a width of 15 (mm).

In the embodiment, the follower rollers 19*b* are disposed on one axis at locations abutting against the rollers 71 and on the center of the sheet. The guide member 45 supports the follower rollers 19*b* to be freely rotatable.

As shown in FIG. 1, the follower rollers 19*b* are positioned relative to the drive roller 19*a*, so that when the drive roller 19*a* and the follower rollers 19*b* discharge the sheet, the center of the sheet in a width direction thereof is inclined with respect to the guide 41 by an angle θ1 equal to or less than 45°.

In the embodiment, the guide rollers 43 made out of a resin are disposed to be rotatable at locations corresponding to the side edges of the sheet. The guide rollers 43 are disposed to face and be away from the shaft rollers 42 (without contact) for pressing the side edges of the sheet.

As shown in FIG. 1, a common tangent line between the drive roller 19*a* and the guide rollers 43, i.e., a direction that the sheet passes through between the drive roller 19*a* and the guide rollers 43, is inclined relative to the horizontal line by an angle θ2. Further, a common tangent line between the drive roller 19*a* and the follower rollers 19*b*, i.e., a direction that the sheet passes through between the drive roller 19*a* and the follower rollers 19*b*, is inclined relative to the horizontal line by an angle θ3.

In the embodiment, the guide rollers 43 are arranged relative to the drive roller 19*a* and the follower rollers 19*b*, such that the angle θ3 becomes larger than the angle θ2 and a angle difference Δθ between the angle θ3 and the angle θ2 is within a following range:

$$0<\Delta\theta<20^\circ$$

As shown in FIG. 7, the guide rollers 43 are arranged symmetrically at locations apart from the line CN by a distance L2. The guide rollers 43 have a width of 16 (mm).

In the embodiment, when the sheet is discharged into the stacker with an image or a printed surface thereof facing down, i.e., a facedown discharge, the guide member 41 as a part of a transporting path guides the sheet. During the process up to the stacker, the sheet changes a transportation direction thereof by more than 30°, thereby making it easy to cause a paper jam. Accordingly, the guide member 41 is arranged away from the guide member 45 to form a gap of 3 (mm) therebetween for preventing the paper jam. Further, the guide member 41 is arranged away from the drive roller 19*a* to form a gap of 4 (mm) therebetween, thereby preventing the guide member 41 from contacting with the drive roller 19*a*.

In the embodiment, the rollers 71 are made out of a rubber, and the shaft 42*a*, the shaft rollers 42, the follower rollers 19*b*, and the guide rollers 43 are made out of a resin. Accordingly, the follower rollers 19*b* and the guide rollers 43 leave no mark on an image on the sheet. The drive roller 19*a* rotates at a speed same as a speed that the sheet is transported when a fixing motor (not shown) as a driving unit is driven. Accordingly, it is possible to prevent the sheet from being loose or extended between the drive roller 19*a* and the fixing device 18.

Figure 8:
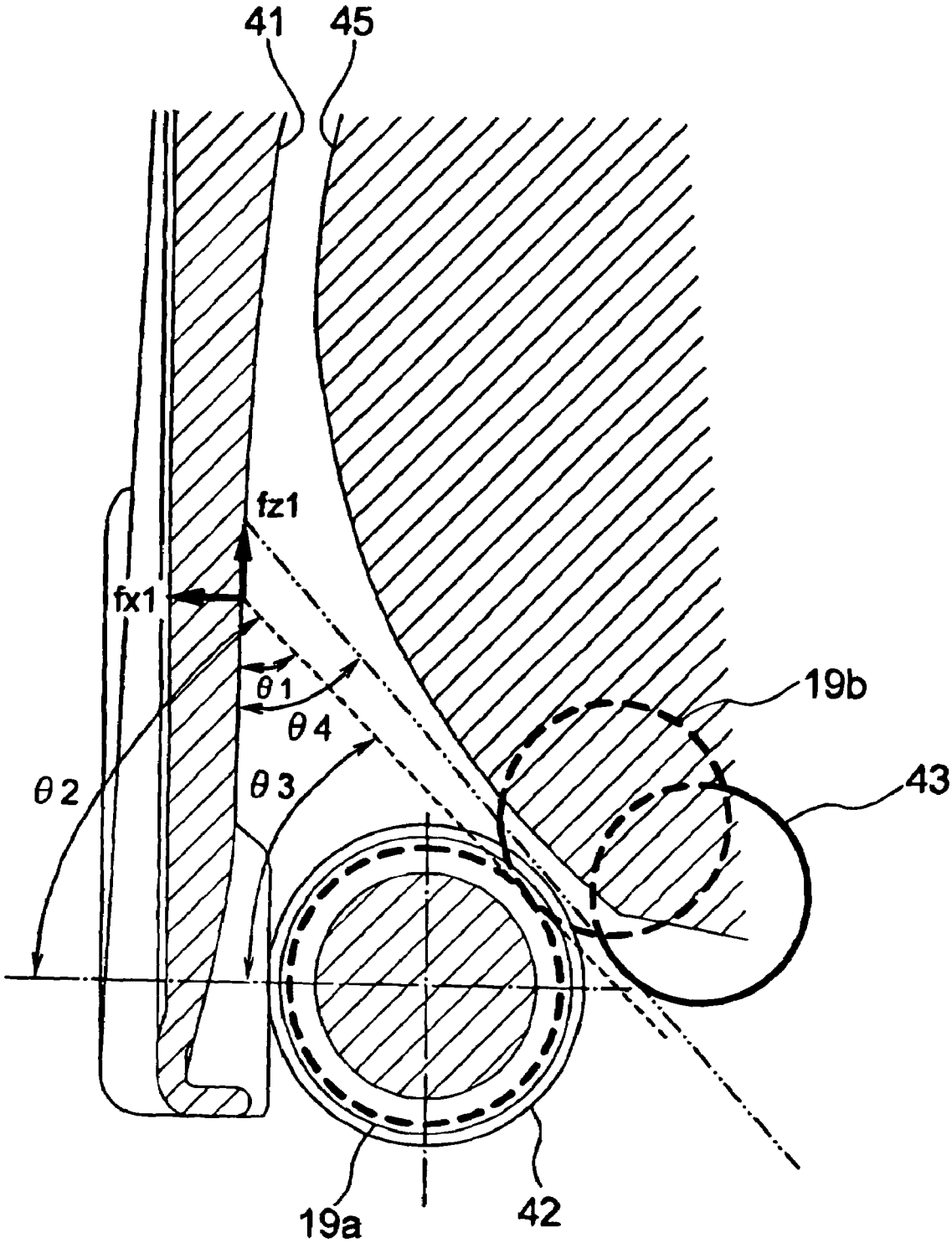
FIG. 8 is a schematic view showing the sheet discharge unit during an operation thereof according to the first embodiment of the present invention.

An operation of the sheet discharge unit will be explained next. FIG. 8 is a schematic view showing the sheet discharge unit during an operation thereof according to the first embodiment of the present invention.

In the embodiment, after the sheet is discharged from the fixing device 18, right and left side edges of a front portion of the sheet first contact with the shaft rollers 42, and then contact with the guide rollers 43. Afterward, the sheet passes through between the drive roller 19*a* and the guide rollers 43, and is transported in a state inclined by the angle θ2 between the horizontal line and the common tangent line of the shaft roller 42 and the guide roller 43, as indicated by a phantom line shown in FIG. 8. Further, the side edges of the sheet contact with the guide member 41 in a state inclined by an angle θ4 relative to the guide member 41.

On the other hand, when the drive roller 19*a* and the follower rollers 19*b* transport and discharge the sheet, the center portion of the sheet moves with the angle θ3 indicated by a hidden line shown in FIG. 8. Then, the center portion of the sheet contacts with the guide member 41 in a state inclined by an angle θ1 larger than the angle θ4 relative to the guide member 41.

As shown in FIG. 8, when the angle θ1, the contact angle of the center portion of the sheet, is larger than 45°, a transportation force fz1 on a tangent line of the guide member 41 becomes equal to or smaller than a force fx1 in a direction perpendicular to the tangent line of the guide member 41. In this situation, when the sheet contacts with the guide member 41, the sheet receives a large reaction force in a direction perpendicular to the tangent line of the guide member 41. As a result, it is difficult to smoothly transport the sheet along the guide member 41.

On the other hand, when the angle θ1 is smaller than 45°, the transportation force fz1 becomes larger than the force fx1. In this situation, when the sheet contacts with the guide member 41, the sheet receives a relatively small reaction force in the direction perpendicular to the tangent line of the guide member 41. As a result, it is possible to reduce resistance between the sheet and the guide member 41, and smoothly transport the sheet along the guide member 41.

As explained above, in the embodiment, the guide rollers 43 are arranged at the positions corresponding to the side edges of the sheet. The shaft rollers 42 facing the guide rollers 43 have a large diameter. The follower roller 19*b* at the center is shifted relative to the guide rollers 43. Accordingly, it is possible to transport the sheet such that the side edges of the sheet contact with the guide member 41 at the angle θ4 smaller than the angle θ1 at which the center portion of the sheet contacts with the guide member.

Accordingly, it is possible to reduce the resistance between the side edges of the sheet and the guide member 41 upon contacting. As a result, the side edges of the sheet are not wound and bent around the guide member 41, thereby smoothly transporting and discharging the sheet.

Second Embodiment

A second embodiment of the invention will be described below. Components in the second embodiment similar to those in the first embodiment are designated by the same reference numerals, and explanations thereof are omitted.

Figure 9:
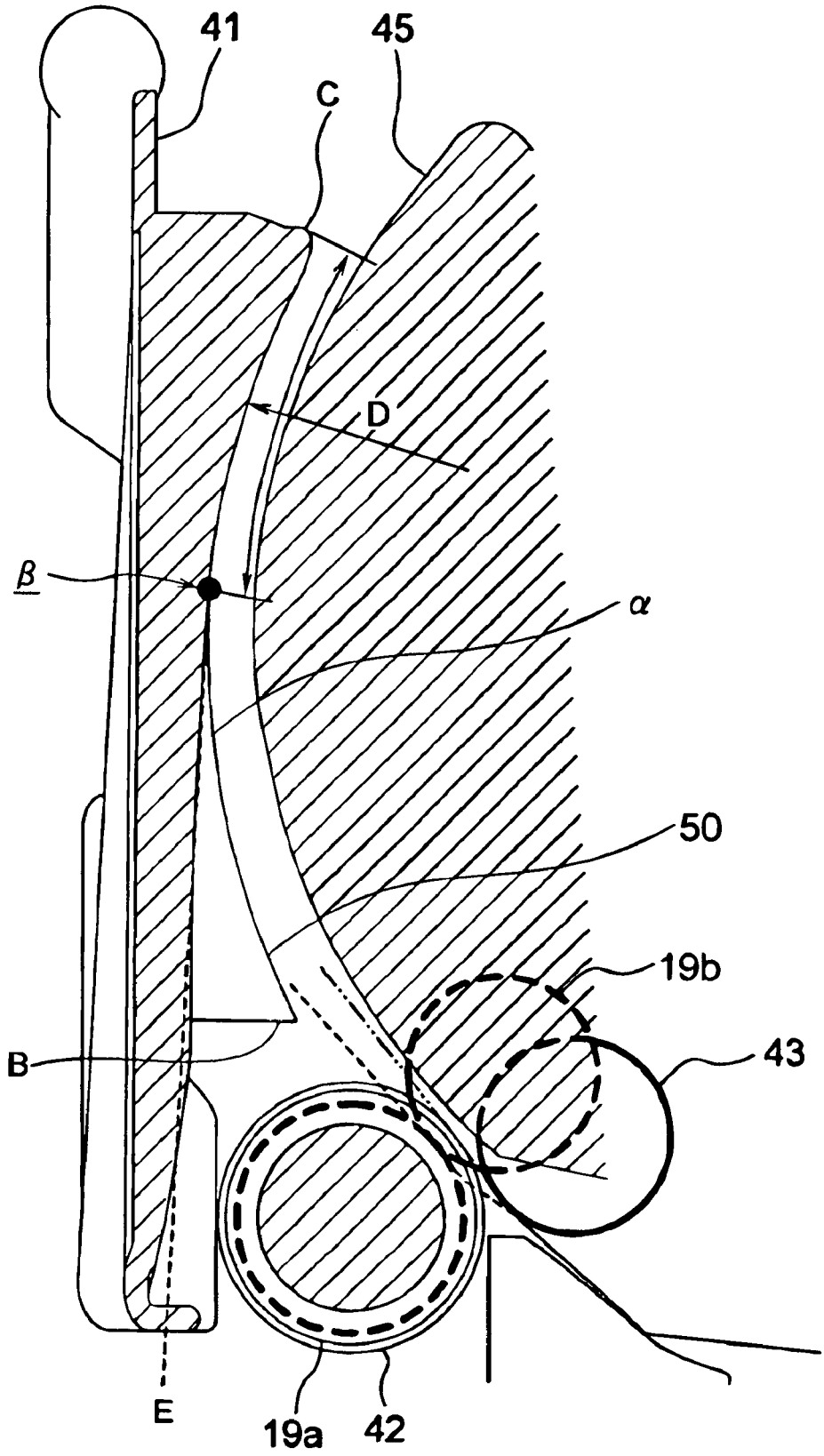
FIG. 9 is a schematic sectional view showing a sheet discharge unit according to a second embodiment of the present invention.
Figure 10:
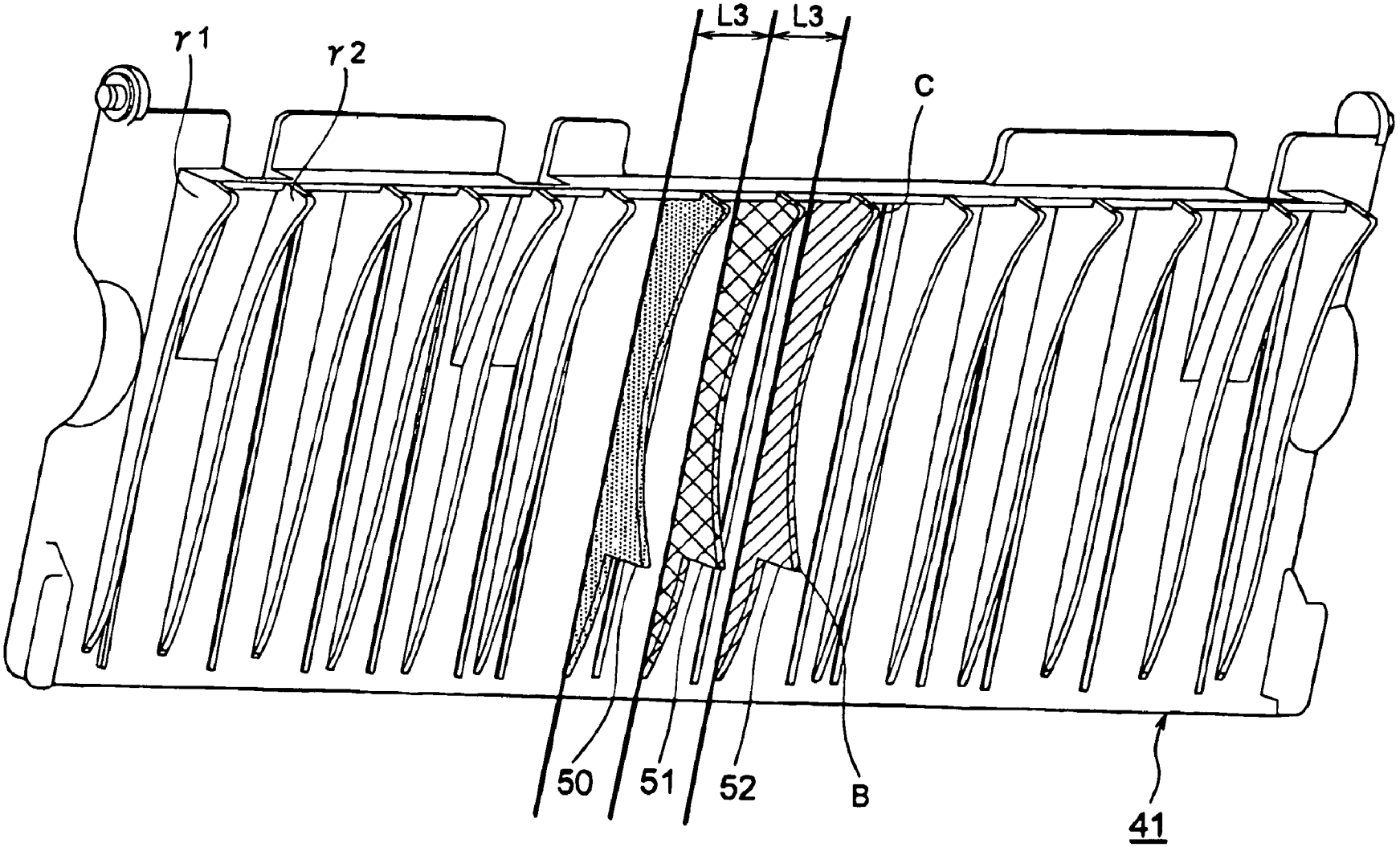
FIG. 10 is a perspective view showing a guide member according to the second embodiment of the present invention.
Figure 11:
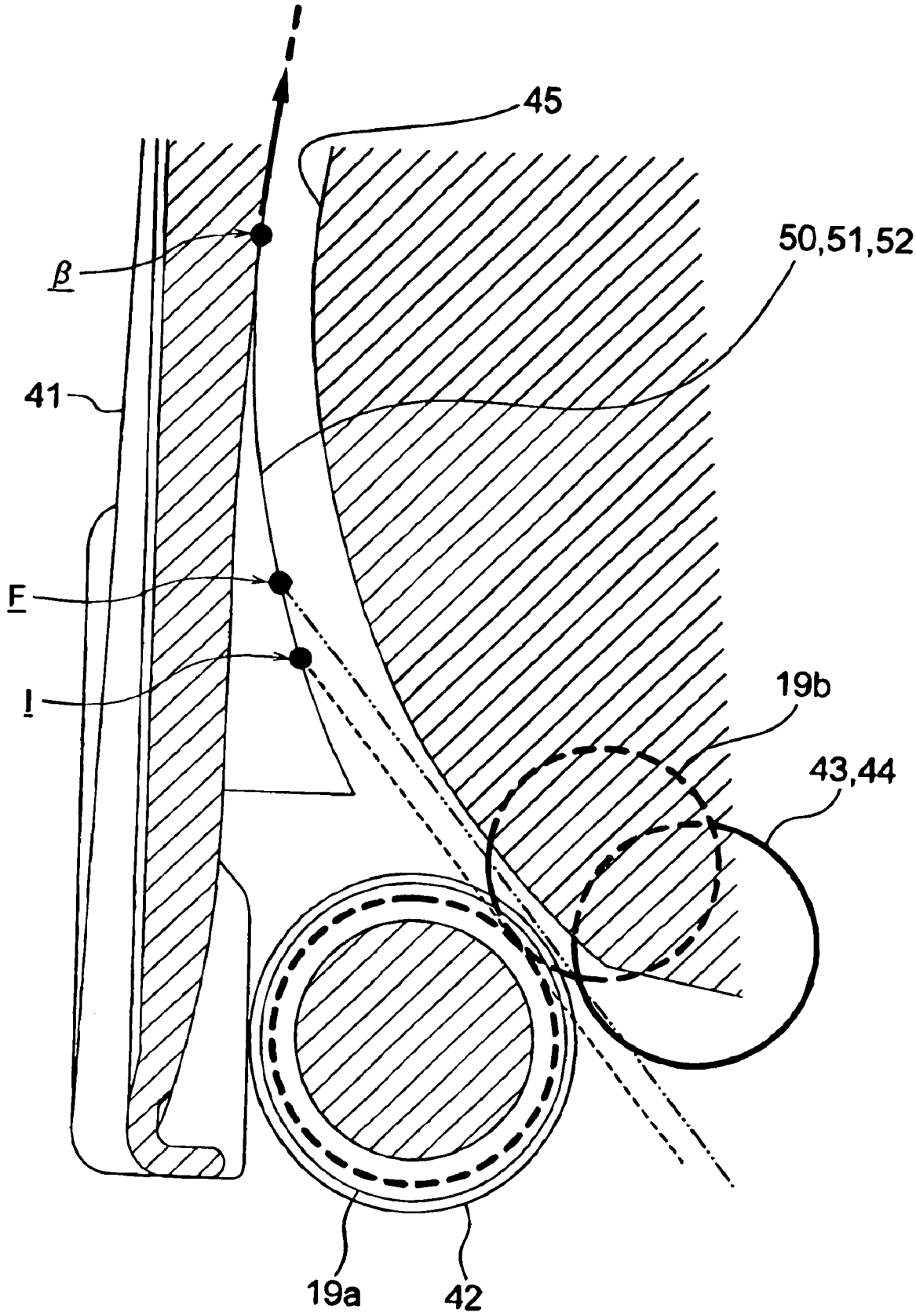
FIG. 11 is a schematic view showing the sheet discharge unit during an operation thereof according to the second embodiment of the present invention.

FIG. 9 is a schematic sectional view showing a sheet discharge unit according to the second embodiment of the present invention. FIG. 10 is a perspective view showing the guide member 41 according to the second embodiment of the present invention. FIG. 11 is a schematic view showing the sheet discharge unit during an operation thereof according to the second embodiment of the present invention.

As shown in FIG. 11, the guide member 41 or the first guide member is provided with a plurality of rib portions r1, r2, . . . on a surface thereof facing the guide member 45 or the second guide member. The rib portions protrude toward the guide member 45, and are arranged with a constant pitch along the direction that the sheet as the recoding medium is discharged.

In the embodiment, rib portions 50, 51, and 52 having a shape different from that of the other of the rib portions are disposed at the center portion of the guide member 41. The rib portions 50, 51, and 52 have projecting portions B projecting toward the guide member 45 at positions close to the drive roller 19*a* and the follower rollers 19*b*, so that the center portion of the sheet is securely placed on the guide member 41. Further, the rib portions 50, 51, and 52 have projecting portions C projecting toward the guide member 41 at edge portions thereof on a downstream side of the direction that the sheet is transported. Accordingly, the rib portions 50, 51, and 52 have smoothly curved recess portions between the projecting portions B and the projecting portions C.

As shown in FIG. 11, the rib portions 50, 51, and 52 have a circular arc with a radius D passing the projecting portion B, the projecting portion C, and a contact point β, i.e., a contact point between a ridge line E of the guide member 41 and an arc α of the guide member 41. Further, the rib portions 50, 51, and 52 have a shape between the contact point β and the projecting portion C same as that of the guide member 41, i.e., the other of the rib portions.

An operation of the sheet discharge unit will be explained next. As shown in FIG. 10, the rib portion 51 is arranged such that a center line thereof is situated on a mechanical center of the printer. Further, the rib portions 50 and 52 are arranged such that center lines thereof are situated at positions away from the center line of the rib portion 51 in left and right directions by a distance L3.

In the embodiment, when the drive roller 19*a* and the follower rollers 19*b* transport and discharge the sheet along a hidden line shown in FIG. 10, the center portion of the sheet contacts with the rib portions 50 to 52 at a point I on the arc with a radius D thereof. After the center portion of the sheet contacts with the rib portions 50 to 52, the sheet is transported toward a downstream side of the rib portions 50 to 52.

In the embodiment, side edge portions of the guide member 41 are located at a level lower than that of the center portion of the guide member 41. Accordingly, when the center portion of the sheet contacts with the rib portions 50 to 52, the side edges of the sheet do not contact with the side edge portions of the guide member 41. When the center portion of the sheet reaches a point F on the rib portions 50 to 52, the front side edges of the sheet are situated at a level same as that of the rib portions 50 to 52.

In the embodiment, the rib portions 50 to 52 are located at a level higher the side edge portions of the guide member 41, and the center portion of the sheet moves along the rib portions 50 to 52. Accordingly, the side edges of the sheet are influenced by a movement of the center portion of the sheet. That is, the side edges of the sheet move in a direction same as that of the center portion of the sheet from the point F. Further, the side edges of the sheet move along the tangent line with respect to the guide member 41 from the contact point β. Accordingly, the side edges of the sheet contact with the guide member 41 at an angle of 0°, thereby generating no resistance force obstructing the sheet from moving. At last, the sheet is discharged as the side edges of the sheet move along the guide member 41.

As described above, in the embodiment, the center portion of the guide member 41 is situated higher than the side edge portions of the guide member 41. Accordingly, it is possible to securely prevent the side edges of the sheet from contacting with the side edge portions of the guide member 41 when the center portion of the sheet contacts with the guide member 41. Further, the center portion of the sheet moves along the guide member 41 before the side edges of the sheet move, and the side edges of the sheet move in the direction same as the tangent line E of the guide member 41. Accordingly, it is possible to smoothly change the moving direction of the side edges of the sheet when the side edges of the sheet contact with the guide member 41.

In the embodiment, the guide member 41 is simply provided with the rib portions 50 to 52 for reducing the resistant force when the side edges of the sheet contact with the guide member 41. As a result, the side edges of the sheet are not wound and bent around the guide member 41, thereby preventing a paper jam and a bent sheet, and smoothly transporting and discharging the sheet.

Third Embodiment

A third embodiment of the invention will be described below. Components in the third embodiment similar to those in the first and second embodiments are designated by the same reference numerals, and explanations thereof are omitted.

Figure 12:
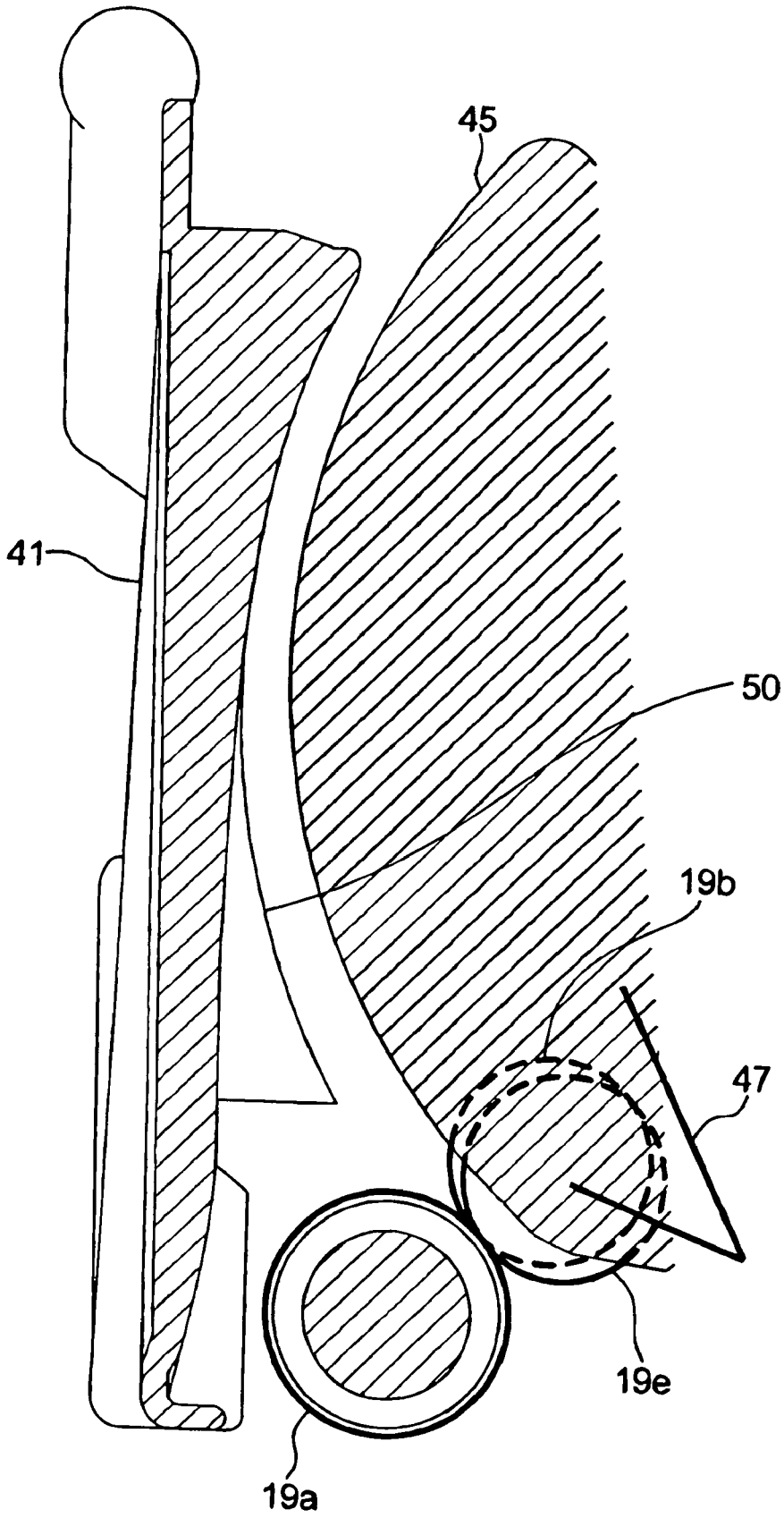
FIG. 12 is a schematic sectional view showing a sheet discharge unit according to a third embodiment of the present invention.

FIG. 12 is a schematic sectional view showing a sheet discharge unit according to the third embodiment of the present invention. As shown in FIG. 12, in addition to the drive roller 19*a* and the follower rollers 19*b*, a follower roller 19*e* is disposed on an upstream side of the follower rollers 19*b* in the direction that the sheet is transported. The follower roller 19*e* may be formed of a plurality of rollers made of a resin. The follower roller 19*e* has an axial center shifted from that of the follower rollers 19*b*. Further, the follower roller 19*e* is attached to the guide member 45 as the second guide member, a spring 47 urges the follower roller 19*e* against the follower roller 19*b* with a pressing force in a range of 45 to 55 gf.

Figure 13:
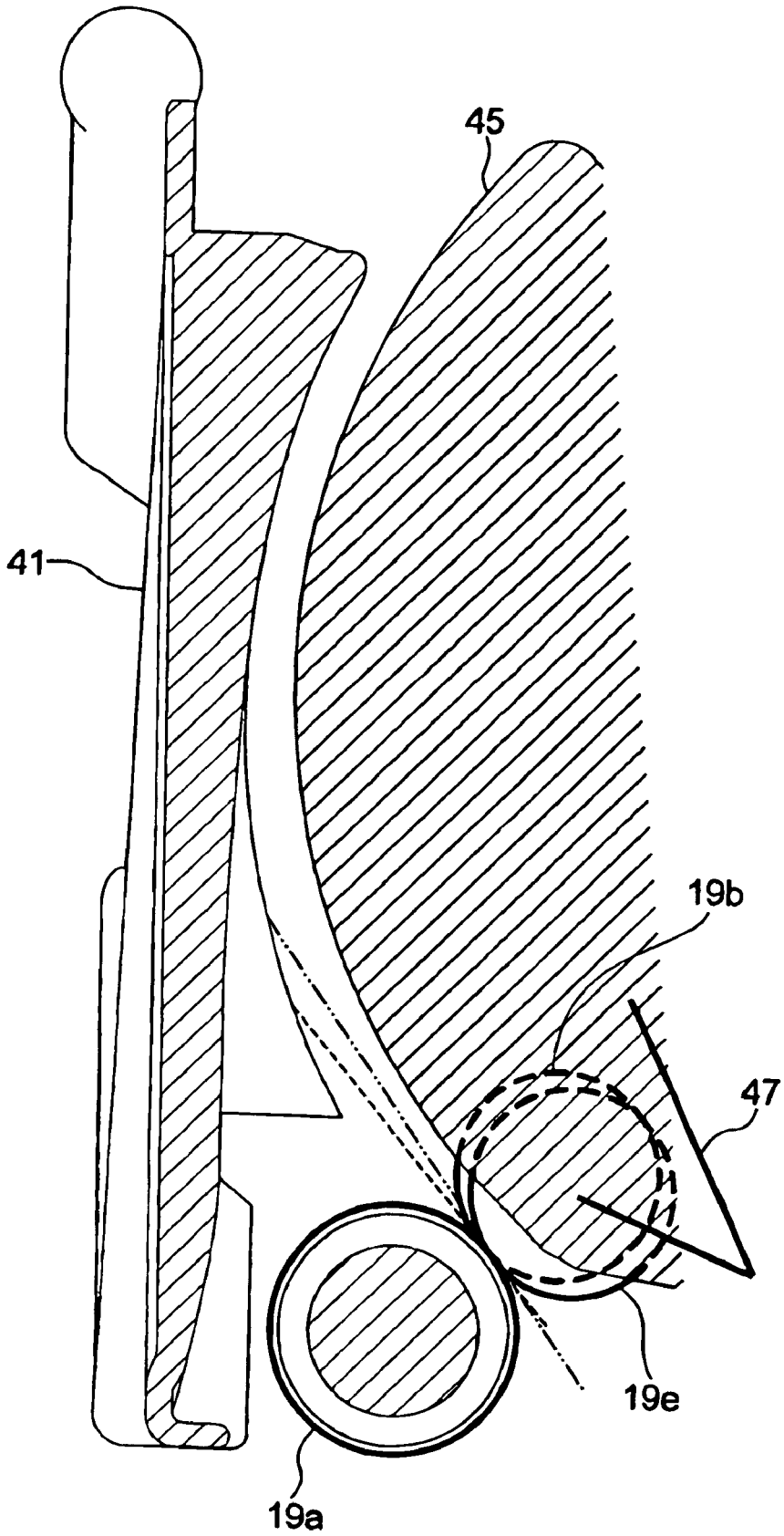
FIG. 13 is a schematic view showing the sheet discharge unit during an operation thereof according to the third embodiment of the present invention.
Figure 14:
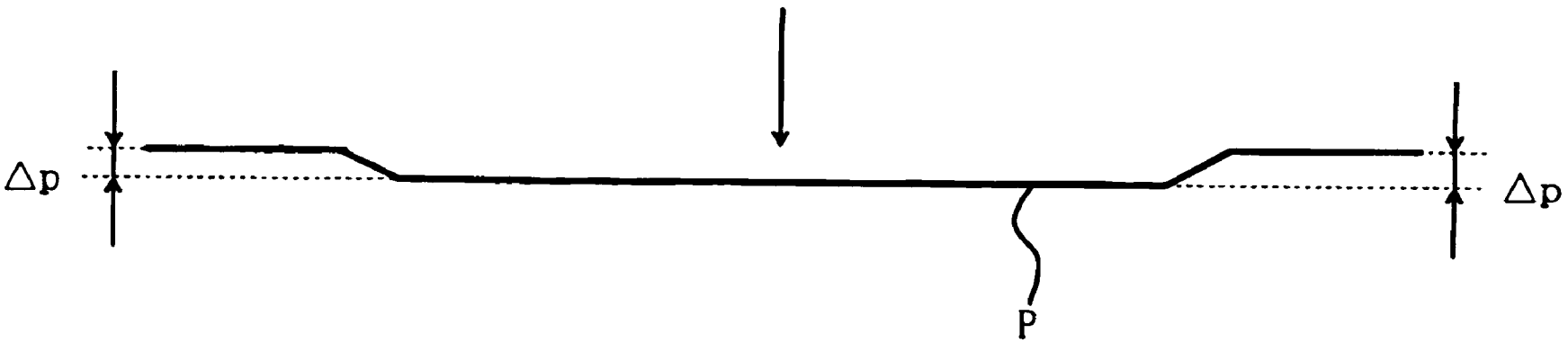
FIG. 14 is a sectional view of a front edge portion of a sheet according to the third embodiment of the present invention.

An operation of the sheet discharge unit will be explained next. FIG. 13 is a schematic view showing the sheet discharge unit during an operation thereof according to the third embodiment of the present invention. FIG. 14 is a sectional view of a front edge portion of the sheet according to the third embodiment of the present invention.

As shown in FIG. 13, after the sheet P is discharged from the fixing device 18, the drive roller 19*a* and the follower roller 19*e* sandwich and transport the side edges of the sheet P along a phantom line. Afterward, the drive roller 19*a* and the follower rollers 19*b* sandwich and transport the center portion of the sheet P along a hidden line. In this case, the sheet P is transported such that the side edges of the sheet P sandwiched with the drive roller 19*a* and the follower roller 19*e* move in a path upward above that of the center portion of the sheet P sandwiched with the drive roller 19*a* and the follower rollers 19*b*.

At this time, the drive roller 19*a* and the follower roller 19*e* sandwich the center portion and the side edges of the sheet. Accordingly, as shown in FIG. 14, the side edges of the sheet P are slightly lifted by an amount Δp with respect to the center portion of the sheet P. In other words, the sheet P is lifted by the amount Δp and curved, thereby increasing rigidity of the sheet P upon being discharged. Accordingly, the sheet P is discharged from the drive roller 19*a* and the follower roller 19*e* in the state that the side edges of the sheet P are slightly lifted with respect to the center portion of the sheet P.

As described above, in the embodiment, the drive roller 19*a*, the follower rollers 19*b*, and the follower roller 19*e* lift the side edges of the sheet P with respect to the center portion of the sheet P. Accordingly, even though the side edges of the sheet P are situated below the center portion of the sheet P upon being discharged from the fixing device 18, it is possible to correct the moving direction of the side edges of the sheet P.

In the embodiments described above, the printer is adopted as the image forming apparatus, and the present invention is applicable to a copier, a facsimile, a multifunction machine, and the likes. Further, the present invention is applied to the sheet discharge unit, and may be applicable to any unit where a sheet is turned.

The disclosure of Japanese Patent Application No. 2006-268784, filed on Sep. 29, 2006 is incorporated in the application by reference.

While the invention has been explained with reference to the specific embodiments of the invention, the explanation is illustrative and the invention is limited only by the appended claims.

What is claimed is:

1. An image forming apparatus comprising:

a driving roller for transporting a medium;

a follower roller disposed to face the driving roller for transporting the medium;

a guide member for guiding the medium to change a transport direction thereof by an angle greater than 30°; and a rotational member disposed to be freely rotatable at a position corresponding to a side edge of the medium, said guide member and said rotational member being arranged so that the side edge of the medium contacts with the guide member at an angle smaller than that of a center portion of the medium contacting with the guide member when the medium contacts with the guide member.

2. The image forming apparatus according to claim 1, wherein said drive roller includes a shaft roller having an outer diameter larger than that of the drive roller so that the side edge of the medium passes through between the rotational member and the shaft roller.

3. The image forming apparatus according to claim 1, wherein said drive roller and said rotational member are arranged to transport the medium at a first angle, said drive roller and said first follower roller being arranged to transport the medium at a second angle smaller than the first angle by 0° to 20°.

4. The image forming apparatus according to claim 1, wherein said rotational member includes a guide roller disposed to be freely rotatable and away from the drive roller.

5. The image forming apparatus according to claim 1, wherein said rotational member includes a second follower roller having an axial center shifted from that of the first follower roller.

6. The image forming apparatus according to claim 1, wherein said guide member includes a center portion and a edge portion, said center portion having a height larger than that of the edge portion.

* * * * *